US006540126B2

(12) United States Patent
Nakamura

(10) Patent No.: US 6,540,126 B2
(45) Date of Patent: Apr. 1, 2003

(54) CLAMPING BAND MANUFACTURING MACHINE AND METHOD OF MANUFACTURING CLAMPING BAND

(75) Inventor: Takeshi Nakamura, Chino (JP)

(73) Assignee: Kabushiki Kaisha Mihama, Nagano (JP)

( * ) Notice: Subject to any disclaimer, the term of this patent is extended or adjusted under 35 U.S.C. 154(b) by 0 days.

(21) Appl. No.: 09/834,227

(22) Filed: Apr. 12, 2001

(65) Prior Publication Data

US 2001/0032870 A1 Oct. 25, 2001

(30) Foreign Application Priority Data

Apr. 25, 2000 (JP) ..... 2000-124639

(51) Int. Cl.[7] ..... B23K 1/20; B23K 37/00; B23K 31/02

(52) U.S. Cl. ..... 228/13; 228/5.7; 228/156

(58) Field of Search ..... 228/13, 5.7, 15.1, 228/41, 156, 170, 173.1

(56) References Cited

U.S. PATENT DOCUMENTS 3,593,907 A * 7/1971 Hahne ..... 228/5.7
3,915,368 A * 10/1975 Ulmer ..... 228/13
4,048,705 A * 9/1977 Blanpain et al. ..... 419/61
4,139,145 A * 2/1979 Moore ..... 228/212
4,192,055 A * 3/1980 Moore ..... 29/281.4
4,481,698 A * 11/1984 Salerno ..... 29/889.22
5,756,167 A * 5/1998 Tamura et al. ..... 428/31
5,948,295 A * 9/1999 Perret et al. ..... 219/125.1

* cited by examiner

*Primary Examiner*—Tom Dunn
*Assistant Examiner*—Zidia Pittman
(74) *Attorney, Agent, or Firm*—Jordan and Hamburg LLP

(57) ABSTRACT

The clamping band manufacturing machine is capable of full-automatically manufacturing the clamping bands and highly increasing the manufacturing efficiency. The machine comprises a main machine part and parts feeding mechanisms. In the main machine part, a band shaping stage welds a clasp on a band section, bends the band section in an arc, and overlaps both end portions of the band section. A lever welding stage welds a lever and the overlapped portion of the band section. An examination stage measures a length of an overlapped portion of the band section and the lever material. An arc shaping stage bends the lever in an arc. A circular shaping stage expands the bent portion of the band section. A conveying mechanism synchronously conveying the band section to each of the sages, which are serially arranged. The feeding mechanisms feed the parts, e.g., the clasp, to the main machine part.

7 Claims, 9 Drawing Sheets

FIG.2A
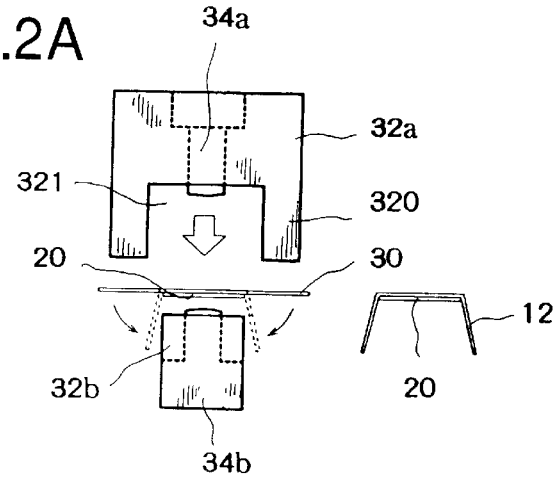
FIG.2B
FIG.3
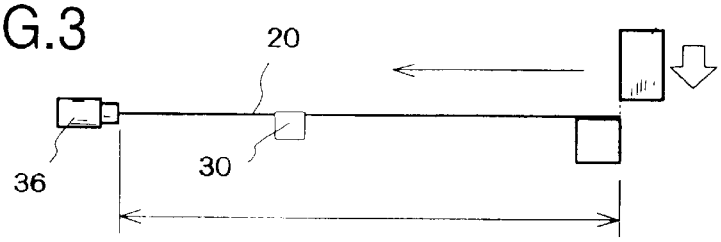
FIG.4A
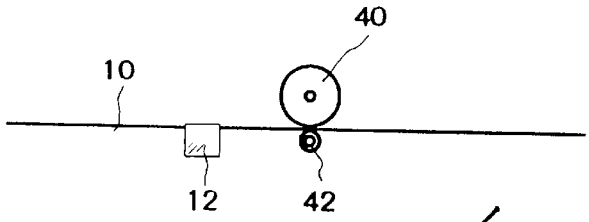
FIG.4B
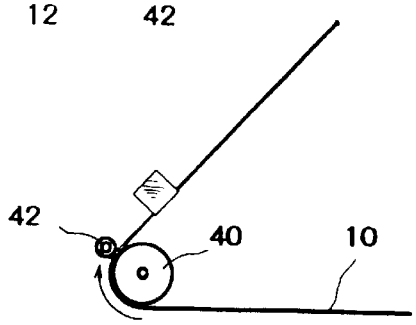
FIG.4C
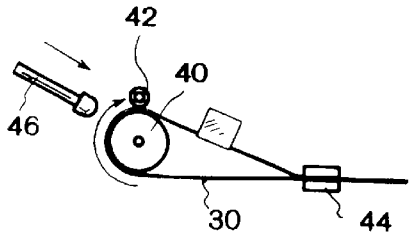

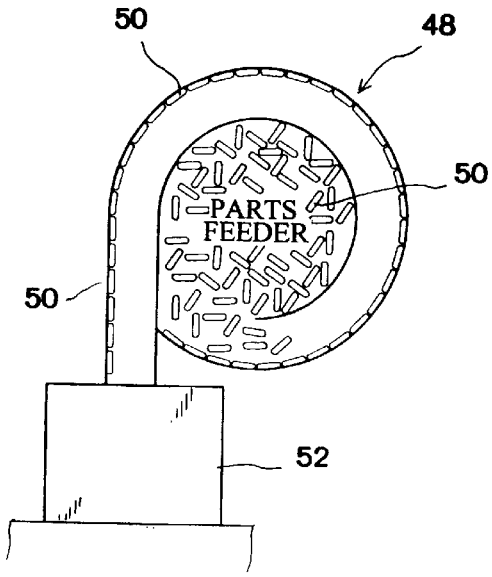
FIG.6
FIG.8A
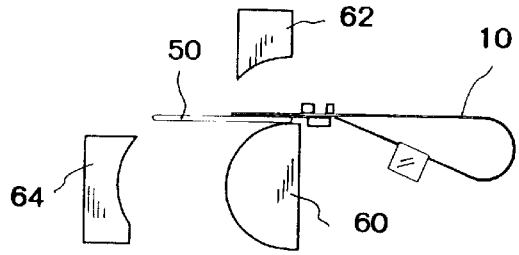
FIG.8B
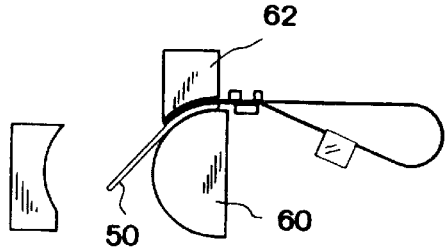
FIG.8C
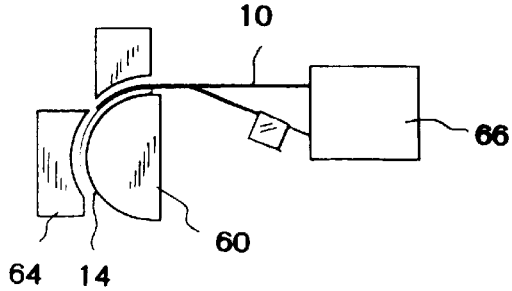

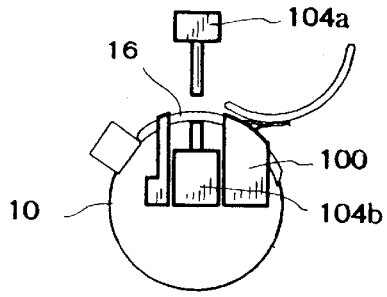
FIG.15A
FIG.15B
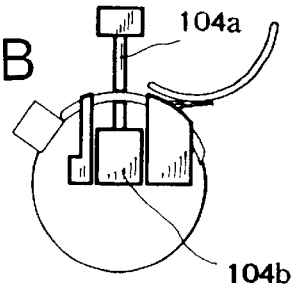
FIG.17
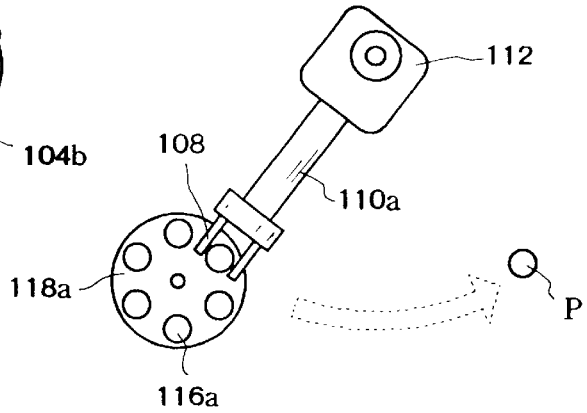
FIG.18A
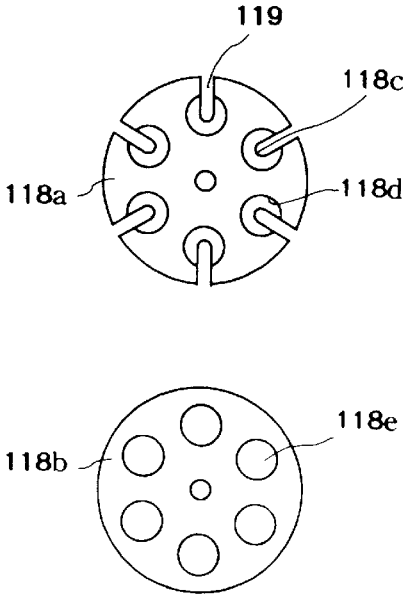
FIG.18B
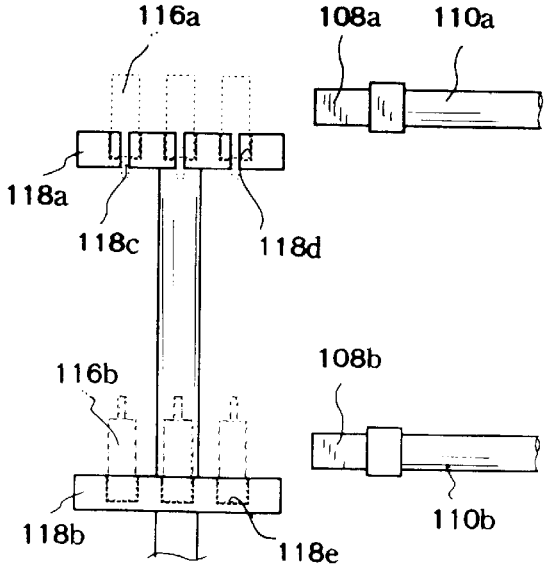

CLAMPING BAND MANUFACTURING MACHINE AND METHOD OF MANUFACTURING CLAMPING BAND

BACKGROUND OF THE INVENTION

The present invention relates to a clamping band manufacturing machine and a method of manufacturing a clamping band, more precisely relates to a machine and a method for full-automatically manufacturing a clamping band.

Clamping bands have used to clamp rubber boots of vehicles, etc. Conventionally, the clamping bands are used to clamp relatively soft materials, e.g., rubber. These days, the clamping bands are used to clamp hard materials, e.g., hard plastics.

A front view of a clamping band having a plate is shown in FIG. 21. The clamping band comprises a band section 10, a clasp 12, a lever 14 and a plate 16. The band section 10 is made of a metal, formed into a circular-shape and both end portions are overlapped. The lever 14 is fixed to the overlapped portion by welding. The lever 14 is welded at a position "X". The lever 14 is turned from a position shown in FIG. 21 to an outer face of the band section 10. By turning the lever 14 until reaching the outer face of the band section 10, an article (not shown) to be clamped is fully clamped by action of lever, then the lever 14 is fixed on the outer face of the band section 10 by the clasp 12. Therefore, a great clamping force is required, so the lever 14 is made of a proper material having enough durability. Further, the lever 14 must be laid along the outer face of the band section 10, so it is formed into an arc-shape.

The clasp 12 is bent to cover the lever 14, which has been fully turned to clamp the article, so as to hold the lever 14 on the outer face of the band section 10. The clasp 12 is welded to the band section 10 at a position "Y". The plate 16 is positioned by sliding along an inner face of the band section 10 until one end of the plate contacts an end of the clasp 12, so that the other end of the plate 16 is extended beyond the overlapped portion of the band section 10. The plate 16 is welded to the band section 10 at a position "Z". Reinforcing portions 16*a* are respectively formed along side edges of the plate 16 so as to reinforce the plate 16. The plate 16 closes a space formed by the overlapped portion of the band section 10 before clamping the article; the plate 16 covers a step portion, which is formed when a part of the band section 10 is moved and located under another part thereof by turning down the lever 14 so as to clamp the article. By employing the plate 16, the article can be wholly clamped with even force.

In the case of clamping hard materials, it is important to control inner diameter of the band section in a clamping state. The inner diameter in the clamping state is defined by length of the band section and length of the overlapped portion of the band section and the lever, so they must be correctly controlled. The lever, the clasp and the plate are fixed to the band section by welding, so welding accuracy also highly influence reliability of the clamping band. If the parts are not fully welded, they will be peeled off from the band section while claming an article. Further, if over current passes and sparks while welding, sharp flashes are formed near the welded positions and they make the clamping band dangerous.

Therefore, the clamping band must be manufactured with fully considering the above described points. The clamping band is manufactured by the steps of: welding the clasp to the band section; overlapping both end portions of the band section and welding them each other; welding the lever to the end portion of the band section; forming the band section into a circular loop; and welding the plate to the inner face of the band section. Namely, many actions, e.g., forming the band sections by cutting a long band-shaped material, forming the clasps, welding the parts, are combined, so the manufacturing steps cannot be full-automatically executed by conventional machines. Two or three steps or actions are executed in one machine, then work pieces must be transferred to another machine for next steps or actions.

Since the clamping bands are manufactured by a plurality of machines, the work pieces must be transferred. So manufacturing efficiency cannot be increased. And, it is difficult manufacture the clamping band having higher accuracy without producing bad products.

SUMMARY OF THE INVENTION

The present invention is invented to solve the above described disadvantages.

An object of the present invention is to provide a clamping band manufacturing machine and a method of manufacturing the clamping band, which are capable of full-automatically manufacturing the clamping bands, highly increasing the manufacturing efficiency, and improving the accuracy of the clamping bands without variation.

To achieve the object, the present invention has following structures.

The clamping band manufacturing machine of the present invention comprises:

- a main machine part including:
  - a band shaping stage for forming a clasp material into a U-shape, welding the U-shaped clasp on a band section made by cutting a long band-shaped material with a prescribed length, bending a mid portion of the band section in an arc by a guide rod, and overlapping both end portions of the band section;
  - a lever welding stage for welding a lever material on the overlapped portion of the band section so as to extend the lever material from the overlapped ends;
  - an examination stage for measuring a length of an overlapped portion of the band section and the lever material;
  - an arc shaping stage for bending the lever material in an arc by a fixed die and a shaping die;
  - a circular shaping stage for expanding the bent portion of the band section so as to form the band section into a circular loop; and
  - a conveying mechanism synchronously conveying the work piece including the band section to each of the sages, which are serially arranged, with machining action of each of the stages; and
- feeding mechanisms for feeding the band-shaped material, the clasp material and the lever material to the main machine part.

In the clamping band manufacturing machine of the present invention, the clamping bands can be full-automatically manufactured, so that the manufacturing efficiency can be highly increased and mass production of the reliable clamping bands can be easily realized.

In the clamping band manufacturing machine, the main machine part may further include a plate welding stage for making one end of a plate, which is bend in arc with curvature corresponding to that of the loop-shaped portion of the band section and which has reinforcing portions formed along both side edges, contact with an end of the clasp so as to position the plate on the loop-shaped portion of the band section and welding the plate thereon. With this structure, the clamping band can be manufactured easily.

In the clamping band manufacturing machine, the circular shaping stage may include:

a bending section for bending the band section at a position near the overlapped portion of the band section and the lever so as to leave the band section away from a front end of the lever;

an expanding section for pressing an outer face of the band section, whose end portions have been overlapped, so as to expand the looped portion of the band section;

a circular shaping section for inserting a bunch of wires into the expanded looped portion of the band section and inserting a columnar shaft into the bunch of the wires so as to shape the looped portion into a circular loop shape; and a finishing section for inserting splitable dies into the circular looped portion of the band section and expanding the same by the splitable dies so as to form into a prescribed circle. With this structure, the band section can be formed into the circular loop with higher accuracy.

In the clamping band manufacturing machine, the arc shaping stage may include:

a fixed die;

a first shaping die for pressing the overlapped portion of the band section and the lever material with the fixed die so as to bend the overlapped portion in an arc; and a second shaping die for pressing the lever material with the fixed die so as to bend the lever material in an arc, the second die being provided near the first shaping die. With this structure, the lever can be formed in the arc with higher accuracy, so buckle of the lever during clamping operation can be prevented and the lever can be securely fixed on the band section in the clamping state.

In the clamping band manufacturing machine, the band welding stage and the lever welding stage may respectively have sensors for detecting sparks, which generate while welding, and discharge the work piece, which is machined when the spark is detected, as a bad product.

In the clamping band manufacturing machine, each of the band shaping stage and the lever welding stage may include a pair of welding rods for pinching and holding welding portion and applying electric current for welding, and the welding rods may be automatically exchanged when they are used predetermined times.

In the clamping band manufacturing machine, the examination stage may include a CCD camera for measuring the length of the overlapped portion of the band section and discharge the work piece, whose length of the overlapped portion is out of an allowable range.

Successively, the method of manufacturing a clamping band, which includes a loop-shaped band section having an overlapped portion, a lever being welded to the band section and a clasp being welded to the band section and capable of holding the lever turned to clamp an article to be clamped, of the present invention comprises the steps of:

forming the band section into a loop-shape;

bending the band section at a position near an overlapped portion of the band section and the lever so as to leave the band section away from a front end of the lever;

pressing an outer face of the band section, whose end portions have been overlapped, by a jig so as to expand the looped portion of the band section;

inserting a bunch of wires into the expanded looped portion of the band section;

inserting a columnar shaft into the bunch of the wires so as to shape the looped portion into a circular loop shape; and inserting a splitable die into the circular looped portion of the band section and expanding the same by the splitable die so as to form into a prescribed circle.

By employing the method of the present invention, the clamping band, in which the band section is formed into a desired circular shape, can be easily manufactured.

BRIEF DESCRIPTION OF THE DRAWINGS

Embodiments of the present invention will now be described by way of examples and with reference to the accompanying drawings, in which:

FIGS. 2A and 2B are explanation views of welding a clasp on a band section;

FIG. 3 is an explanation view of measuring a length of the band section;

FIGS. 4A–4C are explanation views of bending the band section in an arc;

FIG. 6 is an explanation view of a parts feeder;

FIGS. 8A–8C are explanation views of a manner of shaping the lever material.

FIGS. 15A and 15B are explanation views of welding the plate on the band section;

FIG. 17 is an explanation view of an automatic welding rod exchanger;

FIGS. 18A and 18B are explanation views of exchanging the welding rods;

DETAILED DESCRIPTION OF THE PREFERRED EMBODIMENT

A preferred embodiment of the present invention will now be described in detail with reference to the accompanying drawings.

Figure 1:
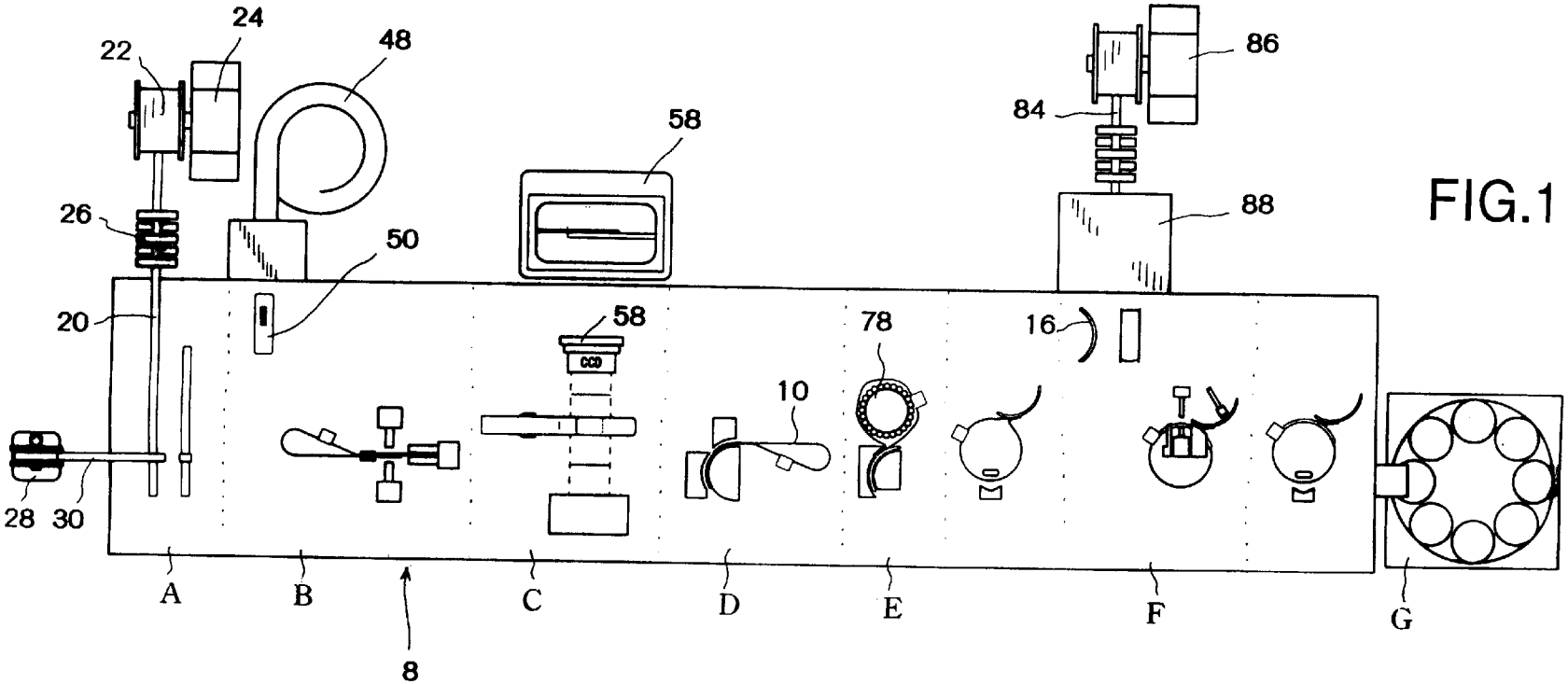
FIG. 1 is a summarized view of the clamping band manufacturing machine of an embodiment of the present invention.

FIG. 1 shows an outline of the clamping band manufacturing machine of the embodiment. A main machine part 8 includes a plurality of machining stages A–F, in which the clamping bands are manufactured, and an accommodating stage G, in which the products (clamping bands) are accommodated. Work pieces are conveyed from the stage A to the stage F, in order, so as to manufacture the clamping bands.

FIG. 1 shows a summarized structure of the clamping band manufacturing machine. Machining steps in the stages will be explained.

In the band shaping stage A, the band section 10 is made by cutting a long band-shaped material 20, which are wound as a coil 22, with a prescribed length, and the clasp 12 is welded on the band section 10. The long band-shaped material 20 is formed by connecting a plurality of metallic bands and wounded as the coil 22. Thus, the long band-shaped material 20 has a plurality of connected portions, but the connected portions are not existed in the band sections 10. To eliminate the connected portions from the band sections 10, detection holes are bored on the both sides of each connected portion. The connected portions can be eliminated by detecting the detection holes by a sensor.

An uncoiler 24 feeds the band-shaped material 20 from the coil 22 to the main machine part 8. The uncoiler 24 rotates the coil 22 to feed the band-shaped material 20. A flattening section 26 makes the band-shaped material 20, which has been sent from the coil 22, flat. A reel stand 28 feeds a long clasp material 30, which will be machined to form the clasps 12. The long clasp material 30 is wound like a coil, held by the reel stand 28 and fed from the reel stand 28. In the present embodiment, the long clast material 30 has no connected portions. The clasp 12 is shorter than the band section 10, so amount of use of the clasp 12 is less than that of the band section 10. Thus, an end of the clasp material 30 may be detected by a sensor, and a new clasp material 30 may be set to the reel stand 28 when the clasp material 30 is completely fed. Feeding the clasp material 30 can be detected by checking if the clasp material 30 is fed into forming dies 32*a* and 32*b*, which form the clasp material 30 into the clasp 12, or not.

A feeding direction of the band-shaped material 20, of which the band section 10 made, and a feeding direction of the clasp material 30, of which the clasp 12 is made, are mutually crossed at the right angle.

In the band shaping stage A, the clasp material 30 is bent to form into the clasp 12, and the clasp 12 is welded to the band section 10. In the present embodiment, the clasp material 30 is fed and located on the band-shaped material 20, then the clasp material 30 is cut and bent at that position so as to form the clasp 12. Further, the clasp 12 is welded on the band-shaped material 20.

In FIG. 2, the clasp material 30 is bent by the forming dies 32*a* and 32*b*, and the clasp 12 is welded on the band-shaped material 20 by welding rods 34*a* and 34*b*. The forming die 32*a* has projected sections 320 so as to bend and form the clasp material 30 into a U-shape. A welding pole of the welding rod 34*a* is exposed in a space 321 formed between the projected sections 320.

The clasp material 30 is pressed by the dies 32*a* and 32*b* to bend and simultaneously welded on the band-shaped material 20 by applying electric current to the welding rods 34*a* and 34*b*. Note that, the dies 32*a* and 32*b* bends and cuts the clasp material 30.

The dies 32*a* and 32*b* have a sensor for checking if the clasp material 30 is correctly set in the dies or not. When the sensor detects the clasp material 30 at the correct position, the clasp material 30 can be bent correctly.

A main control item of bending and welding the clasp 12 is welding conditions: the electric current and the clamping force of the welding rods 34*a* and 34*b*. If the electric current or the clamping force is deviated from an allowable range, alert signals are generated and the machine is stopped. To improve reliability of welding, the welding rods 34*a* and 34*b* are automatically exchanged when they are used predetermined times. With this action, a long time operation can be continuously executed.

A manner of measuring the length of the band-shaped material 20, which is sent from the coil 22, by a sensor 36 and cutting the band section 10 having the prescribed length will be explained with reference to FIG. 3. The sensor 36 can correctly measure the length of the band-shaped material 20, which is sent a prescribed length. A front end of the clasp material 30 is a standard position of feeding the clasp material 30 to the prescribed position. The action of cutting the band-shaped material 20 is executed after the dies 32*a* and 32*b* form the clasp 12.

When the connected portion of the band-shaped material 20 sent from the coil 22, the action of the dies 32*a* and 32*b* is once stopped, then the band-shaped material 20 is cut. The band-shaped material 20 including the connected portion, which has been cut, is discharged.

After the claps 12 is welded on the band section 10, the flat band section 12 is bent.

A manner of bending the band section 10 will be explained with reference to FIGS. 4A–4C. A columnar guide rod 40 acts as a guide of bending and curving the band section 10. A press roller 42 rolls on an outer face of the band section 10 so as to press the band section 10 onto an outer circumferential face of the guide rod 40.

In FIG. 4A, the band section 10 is not bent and curved. The guide rod 40 is located at a mid portion of the longitudinal direction of the band section 10. The band section 10 is pinched between the guide rod and the press roller 42.

In FIG. 4B, the press roller 42 is moved from the position shown in FIG. 4A so as to press the band section 10 onto the outer circumferential face of the guide rod 40. By pressing onto the guide rod 40, one end of the band section 10, which is located on the upper side of the guide rod 40, is gradually moved toward the other end thereof with the travel of the press roller 42.

In FIG. 4C, the press roller 42 is further moved, so that the both end portions of the band section 10 are overlapped. The overlapped end portions are clamped by a damper 44. Curvature of the curved mid portion of the band section 10 is defined by a diameter of the guide rod 40. If the both ends of the band section 10 are not corresponded, an air cylinder unit 46 is driven to correspond the ends.

Figure 5A:
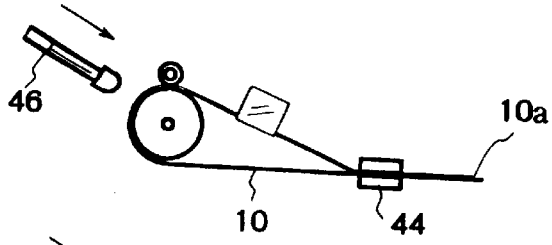
FIGS. 5A and 5B are explanation views of positioning both end portions of the band section.
Figure 5B:
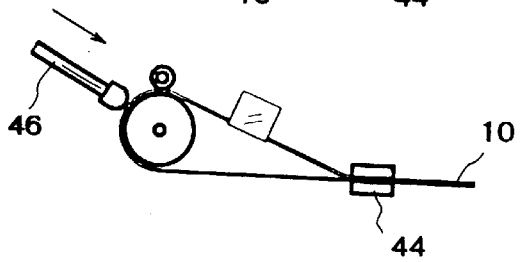

FIG. 5A shows the state, in which the both ends of the band section 10 are not corresponded. The one end 10*a* is extended from the other end. In FIG. 5B, a rod of the air cylinder unit 46 contacts the outer face of the band section 10, so that the both ends of the band section 10 are corresponded. When the rod of the air cylinder unit contacts the outer face of the band section 10, the damper 44 slightly loosen. Then the air cylinder unit 46 makes the ends of the band section 10 contact a stopper (not shown), so that the both ends of the band section 10 can be corresponded. This corresponding action directly influences an inner diameter and the clamping force of the clamping band, so this action is very important.

In the lever welding stage B, the lever material 50 is welded on the band section 10, which has been bent.

To transfer the work piece (the band section 10 on which the clasp 12 is welded) from the band shaping stage A to the lever welding stage B, a rotary table, on which a pair of chucks are provided with an angular separation of 180°, is provided there between. The work piece, which has been machined in the band shaping stage A, is chucked by one chuck, then the rotary table is synchronously rotated 180° with action of the lever welding stage B so as to transfer the work piece to the lever welding stage B. With this action, the other chuck is moved from the lever welding stage B to the band shaping stage A for next transferring action.

The lever material 50 is fed by a parts feeder 48 (see FIG. 1). The parts feeder 48 is located near the main machine part 8 and intermittently feeds the lever materials 50 to the lever welding stage B. An enlarged view of the parts feeder 48 is shown in FIG. 6. In the present embodiment, the lever materials 50 are previously cut and their cut end faces are rounded by a barrel treatment. When the clamping band clamps an article, a great force concentrates to a fulcrum point of the lever 14, so if the cut end faces of the lever are not rounded, sharp edges of the cut end faces damages or cuts the band section 10. Note that, the lever materials 50 are sometimes deformed by the barrel treatment, so a selecting device, which selects and discharges bad products, is provided in the parts feeder 48.

As shown in FIG. 6, the parts feeder 48 lines the lever parts 50 and feeds them to the main machine part 8 one by one.

A carving section 52 carves a product identification symbol to the lever material 50.

A long band-shaped lever material may be used instead of the lever materials 50, which have been previously cut. In this case, the long band-shaped lever material may be cut, with a length of the lever 14, by press means, then the lever materials cut may be sent to the barrel treatment section and the carving section 52.

A manner of welding the lever material 50 on the band section 10, which has been bent and curved, will be explained with reference to FIGS. 7A–7C. One end section of the lever material 50, which has a prescribed length, is overlapped on the overlapped portion of the band section 10 and welded thereon. Namely, the both end sections of the band section 10 and the lever material 50 are simultaneously welded.

Figure 7A:
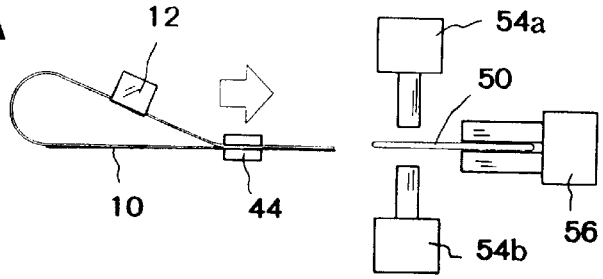
FIGS. 7A–7C are explanation views of welding a lever on the band section.
Figure 7B:
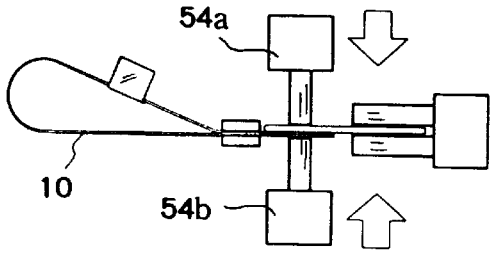
Figure 7C:
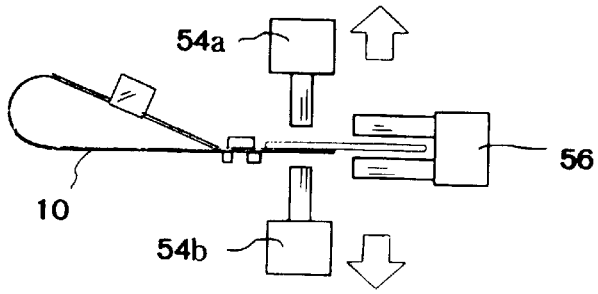

In FIG. 7A, a pair of welding rods 54*a* and 54*b* are vertically arranged. The lever material 50 is positioned at a prescribed position for welding. The band section 10, which has been bent and curved, are moved to be welded. A hand 56 conveys the lever material 50. In FIG. 7B, the band section 10 and the lever material 50 are clamped by the welding rods 54*a* and 54*b*. In FIG. 7C, the welding rods 54*a* and 54*b* are moved away from the band section 10, and the hand 56 releases the lever material 50. The band section 10, on which the lever material has been welded, will be conveyed to the nest stage.

Important items of the present stage are: controlling welding conditions, e.g., electric current intensity, force of clamping the band section 10; and correctly positioning the lever material 50 on the band section 10. If abnormal electric current is applied, alert signals are generated and the machine is stopped. If a spark is detected, the product is automatically discharged as a bad product. In the present embodiment, the alert signals are generated if a first spark is detected; the machine is stopped if a second spark is detected. The welding rods 54*a* and 54*b* are automatically exchanged when they are used predetermined times so as to stably execute welding.

If the lever material 50 is shifted from the correct position on the band section 10, the inner diameter of the clamping band is badly influenced, so the lever material 50 must be correctly positioned. The lever material 50 can be correctly positioned by precisely conveying the band section 10 and the lever material 50.

The examination stage C measures the length of the overlapped portion of the band section 10 and the lever material 50, which have been integrated by welding. The band section 10, to which the lever material 50 has been welded, is conveyed to the lever welding stage B to the examination stage C by a conveying mechanism, which is equal to the conveying mechanism for conveying the band section 10 from the band shaping stage A to the lever welding stage B. Namely, a rotary table, on which a pair of chucks are provided with an angular separation of 180°, is provided between the stages and capable of rotating in a vertical plane. The work piece, which has been welded in the lever welding stage B, can be transferred to the examination stage C. In this case too, the rotary table is synchronously driven with actions of the stages B and C.

A CCD camera 58 for measuring the length of the overlapped portion of the band section 10 and the lever material 50 is shown in FIG. 1. The length can be measured by image processing. The lever material 50 is accidentally shifted in the transverse direction and the longitudinal direction with respect to the band section 10. The shift in the longitudinal direction badly influences the inner diameter of the clamping band. In the examination stage C, the length of the overlapped portion of the band section 10 and the lever material 50 of all products. If the length is deviated from an allowable range, the product is discharged as a bad product. When the bad products are continuously detected, the machine is stopped as a machine trouble.

The arc shaping stage D bends the lever material 50 in an arc. The lever material 50 is bent in an arc from a base end, which is on the overlapped portion side, to a front free end. A manner of shaping the lever material 50 is shown in FIGS. 8A–8C. The lever material 50 is bent by a fixed die 60, a first forming die 62 for bending the base end of the lever material 50, and a second forming die 64 for bending the rest of the lever material 50. In FIG. 8A, the lever material 50, which has been welded on the band section 10, is set on the fixed die 60. In FIG. 8B, the base end of the lever 50 is pressed and bent in an arc by the fixed die 60 and the first forming die 62. While the fixed die 60 and the first forming die 62 clamp the lever material 50, the rest of the lever material 50 is pressed and bent in an arc by the fixed die 60 and the second forming die 64, so that the lever material can be wholly bent in an arc. In FIG. 8C, the work piece, whose lever material 50 has been wholly bent in an arc, is released and sent to the next stage by a hand 66.

In the present embodiment, the lever material is bent in an arc by the fixed die 60 and two movable dies: the first and the second forming dies 62 and 64, so that pressing force can be evenly applied to the whole lever material 50 and the lever material 50 can be precisely bent. By employing the two movable dies, the base end and the rest of the lever material 50, whose thickness are different, can be evenly bent in an arc.

Conventionally, the lever material 50 is bent by one fixed die and one movable die, so a mid part of the lever material is apt to be broken and both ends of the lever material are apt to be extended. Since great force is applied to the lever 14 when the clamping band clamps an article, stress concentrates to the broken part of the lever 14 and the lever 14 is buckled. Further, if the whole lever 14 is evenly bent in an arc, the lever 14 partially leaves from the outer face of the band section 10 when the clamping band clamps the article.

Note that, a rotary table, which is capable of rotating in a vertical plane, conveys the work piece from the examination stage C to the arc shaping stage D as well as the conveying mechanism between the stages B and C.

The circular shaping stage E expands the bent loop portion of the band section 10 so as to form the band section into a circular loop.

Figure 9:
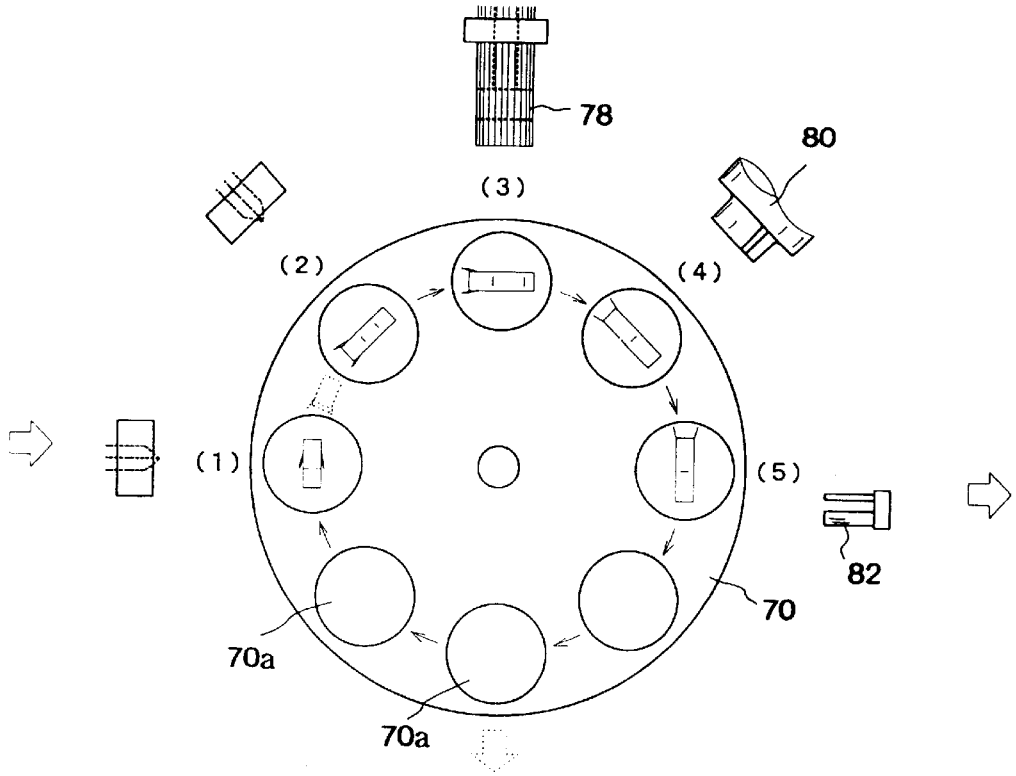
FIG. 9 is a front view of a circular shaping stage.

FIG. 9 is a front view of the circular shaping stage E; FIGS. 10A–E show machining steps executed in the circular shaping stage E. In the present embodiment, machining tools are provided along an outer edge of a circular rotary table 70. Setting sections 70*a*,on which the work pieces are set, are provided on the rotary table 70 with regular angular separations. The rotary table 70 is turned prescribed angle for each machining work. By providing the tools along the outer edge of the rotary table 70, a plurality of machining works can be efficiently executed and size of the machine can be smaller.

Figure 10A:
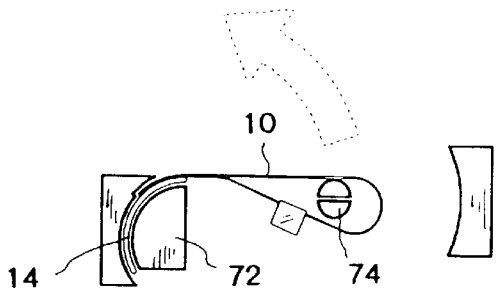
FIGS. 10A–10E are explanation views of forming the band section into a circular loop.
Figure 10B:
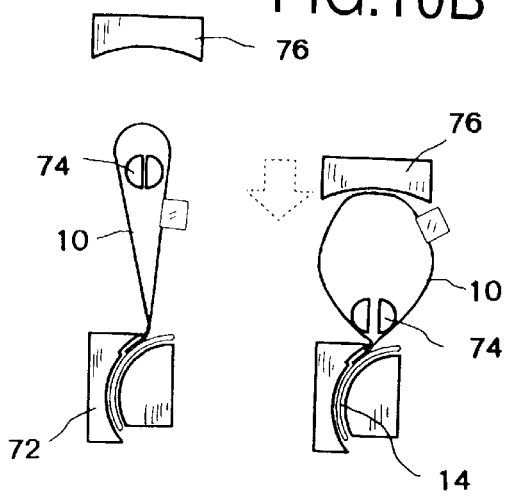

Machining in a section (1) shown in FIG. 9 will be explained with reference to FIG. 10A. A chuck 73 clamps the lever 14, and a base portion of the band section 10 is bent to turn the loop portion thereof in a direction of an arrow. The loop portion of the band section 10 is moved from a horizontal position (FIG. 10A) to a vertical position (FIG. 10B). A movable guide 74 is inserted in the loop portion of the band section 10. By moving the movable guide 74 in the direction of the arrow shown in FIG. 10A, the looped portion of the band section 10 can be moved to the vertical position.

Machining in a section (2) shown in FIG. 9 will be explained with reference to FIG. 10B. The looped portion of the band section 10 is circularly expanded. Namely, the movable guide 74 is downwardly moved from an uppermost position, which is near the bent mid portion of the band section 10, so that the looped portion of the band section 10 is slightly expanded. Simultaneously, a press block 76 downwardly presses the outer face of the bent mid portion of the band section 10, so that the looped portion of the band section 10 can be sidewardly expanded.

Figure 10C:
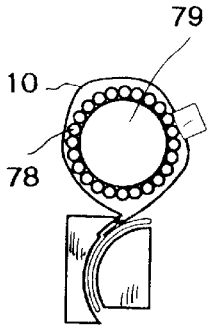

Machining in a section (3) shown in FIG. 9 will be explained with reference to FIG. 10C. A bunch of a plurality of wires 78 are inserted into the looped portion of the band section 10. Further, a forming shaft 79 is inserted into the bunch of the wires 78 so as to form the looped portion of the band section 10 into a circular shape. The wires 78 guide the forming shaft 79 when the looped portion of the band section 10 into the circular shape. The wires 78 are arranged in the looped portion of the band section 10, in the circumferential direction, with regular separations. Outer diameters of the wires 78 and the forming shaft 79 are defined on the basis of a desired inner diameter of the bunch of the wires 78 nearly equal to a designed inner diameter of the clamping band. FIG. 10C shows the state of inserting the forming shaft 79 in the bunch of the wires 78. By inserting the forming shaft 79 into the bunch of the wires 78, the wires 78 forms the looped portion of the band section 10 into the circular shape.

Figure 10D:
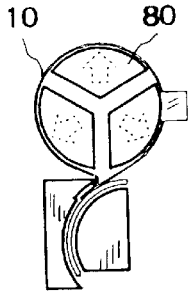

Machining in a section (4) shown in FIG. 9 will be explained with reference to FIG. 10D. A splitable jig 80, which can be divided into three pieces, is inserted into the circular looped portion of the band section 10. The three pieces of the jig 80 are radially moved outward so as to make the inner diameter of the circular looped portion equal to prescribed value. By employing the splitable jig 80, the looped portion of the band section 10 can be precisely formed into the circle.

Figure 10E:
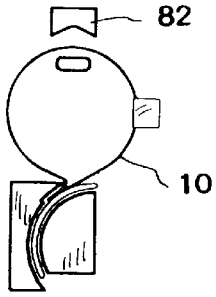

An action in a section (5) shown in FIG. 9 will be explained with reference to FIG. 10E. The band section 10 having the circular looped portion is held by a chuck 82 and conveyed to the next stage.

Conventionally, the manner of circularly shaping the looped portion of the band section 10 by the bunch of the wires and the forming shaft has been used. However, the looped portion is expanded and shaped in one step, so that the band section 10 cannot be formed into a circle. On the other hand, in the present embodiment, the looped portion of the band section 10 is once expanded, then the looped portion is expanded and formed into the circle by the wires 78. Further, the looped portion is precisely formed into the circle by the splitable jig 80, so that the looped portion can be precisely formed into the circle.

In the case of the clamping band having no plate 16, the clamping band is completely manufactured at the section (5), and the product is conveyed to a product accommodating step.

The plate welding stage F welds the plate 16 onto the looped band section 10. The final machining step is executed therein.

In FIG. 1, a long band-shaped plate material 84 is wound like a coil and set in an uncoiler 86. The uncoiler 86 intermittently feeds the plate material 84 with a prescribed length. In the plate material 84 too, detecting holes for detecting connected portions of the plate material 84 are bored on both sides of each connected portion. The detecting holes are detected by a sensor, so that the connected portions can be eliminated from the plates 16.

Figure 11:
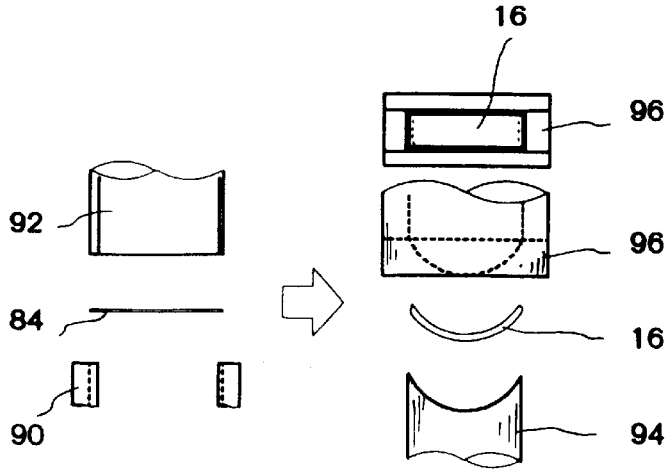
FIG. 11 is an explanation view of forming a plate.

The plate material 84, which has been fed, is formed into the plate 16 by a press section 88. In FIG. 11A, the long plate material 84 is cut, by a die 90 and a punch 92, so as to make the plate 16. In FIG. 11B, the plate 16 is bent in an arc by dies 94 and 96, and the reinforcing sections 16a are simultaneously formed along the side edges of the plate 16.

The plate 16, which has been shaped in the press section 88, is correctly set on the inner face of the band section 10 and welded thereon.

Figure 12:
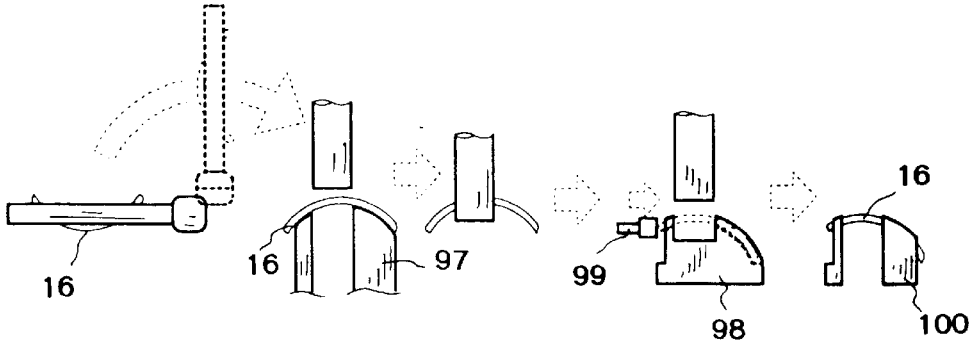
FIG. 12 is an explanation view of setting the plate on a welding table.

When the plate 16 is welded on the band section 10, one end face of the plate 16 must contact an inner side face of the clasp 12. A manner of welding the plate 16 onto the band section 10 will be explained with reference to FIGS. 12 and 13A–13C. FIG. 12 shows the steps of holding the plate 16, which has been formed into a prescribed shape, on a welding table 100. The plate 16, which has been formed into a prescribed shape, is headed upward and transferred to a jig 97, further correctly positioned on a jig 98 by an air cylinder unit 99, then transferred onto the welding table 100.

Figure 13A:
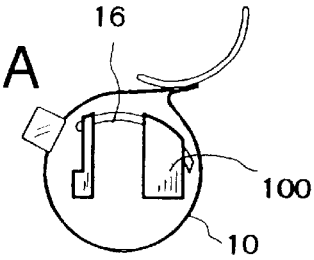
FIGS. 13A–13C are explanation views of setting the band section to the plate.
Figure 13B:
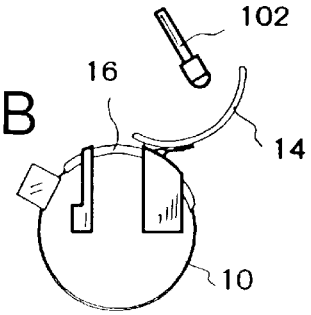
Figure 13C:
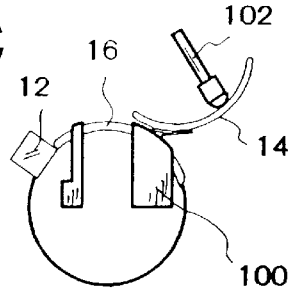
Figure 14:
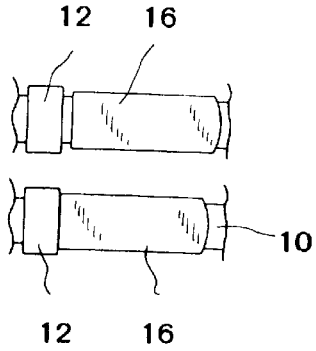
FIG. 14 is an explanation view of a relationship between the clasp and the plate.

After the plate 16 is transferred to the welding table 100, the circular looped portion of the band section 10 is set to cover the welding table 100 as shown in FIG. 13A. FIG. 13B shows a state of setting the looped portion of the band section 10 on the plate 16, which is held by the welding table 100. When the plate 16 is welded, the plate 16 contacts an end face of the clasp 12, so the lever 14 shown in FIG. 13B is softly pushed by an air cylinder unit 102 so as to make the end face of the clasp 12 contact the end face of the plate 16. The band section 10 is slid on the plate 16, and the end face of the clasp 12 contacts the end face of the plate 16. FIG. 14 shows a state of separating the clasp 12 from the plate 16 and a state of closing the separation there between.

A manner of welding the plate 16 and the band section 10, which are held by the welding table 100, by welding rods 104*a* and 104*b* will be explained with reference to FIGS. 15A and 15B. While welding the plate 16 on the band section 10, electric current intensity and clamping force of the welding rods 104*a* and 104*b* are precisely controlled to securely weld. The welding rods 104*a* and 104*b* are also automatically exchanged when they are used predetermined times so as to stably execute welding.

Figure 16:
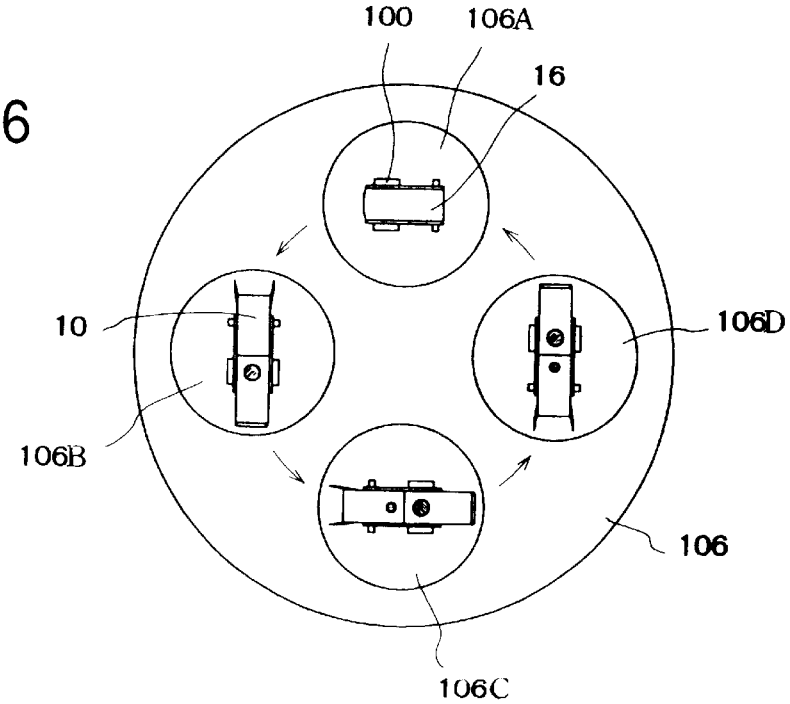
FIG. 16 is a plan view of a rotary table, on which the plate is welded on the band section.

FIG. 16 shows a rotary table 106, which is used for welding the plate 16 on the band section 10. A plurality of machining stages 106A–106D are provided on the rotary table 106. At the machining stage 106A, the plate 16 is held by the welding table 100; at the machining stage 106B, the band section 10 is mounted on the plate 16 and correctly positioned; at the machining stage 106C, the plate 16 is welded on the band section 10; and at the machining stage 106D, the band section 10, on which the plate 16 has been welded, is taken out.

After the plate 16 is welded on the band section 10, the plate 16 is securely checked if the plate 16 is correctly and securely welded on the band section 10 or not. The good product is conveyed to the accommodating stage G. At the accommodating stage G, the product are counted and a prescribed number of the products are packed.

Note that, an automatic welding rod exchanger is shown in FIGS. 17, 18A and 18B. In each of the cases of welding the clasp 12, the lever 14 and the plate 16 on the band section 10, a pair of the welding rods pinch or clamp the work piece for welding. In FIG. 17, an arm 110*a* having a chuck 108 is swung, between a welding position P and a bolster 118*a*, by a driving mechanism so as to exchange the welding rod 116*a*. Since a pair of the welding rods are employed, a pair of the bolsters 118*a* and 118*b* are vertically arranged as shown in FIG. 18B. The welding rods 116*a* and 116*b* are respectively set in the bolsters 118*a* and 118*b*, and poles of the welding rods 116*a* and 116*b* are faced each other.

FIG. 18A shows plan views of the bolsters 118*a* and 118*b*. The upper bolster 118*a* has small through-holes 118*c*, through each of which the pole of the welding rod 116*a* is pierced, concave sections 118*d*, in each of which the welding rod 116*a* is set, and notches 119, each of which is radially formed from an outer circumferential face of the bolster 118*a* until reaching each of the small through-holes 118*c*. With this structure, the welding rod 116*a* can be radially pulled out, by a chuck 108*a*, from the concave section 118*d* via the notch 119. On the other hand, the lower bolster 118*b* has concave sections 118*e*, in each of which the welding rod 116*b* is set. A chuck 108*b* lifts the welding rod 116*b* upward to exchange.

Action of the welding rod exchanger, which exchanges the welding rods 116*a* and 116*b*, shown in FIGS. 17, 18A and 18B will be explained.

When the welding rods 116*a* and 116*b* weld the predetermined times, firstly the welding rods 116*a* and 116*b* locating at the welding positions are chucked and set to vacant positions. Next, the bolsters 118*a* and 118*b* are turned, and the new welding rods 116*a* and 116*b* are moved to chucking positions, at which they can be respectively chucked by the chucks 108*a* and 108*b*. Then, the new welding rods 116*a* and 116*b* are chucked by the chucks 108*a* and 108*b*, transferred to the welding positions, and the welding rods 116*a* and 116*g* are fixed to welding means.

Figure 19:
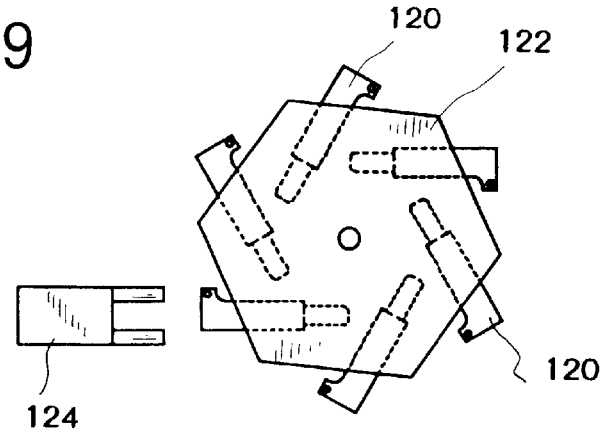
FIG. 19 is an explanation view of another automatic welding rod exchanger.
Figure 20:
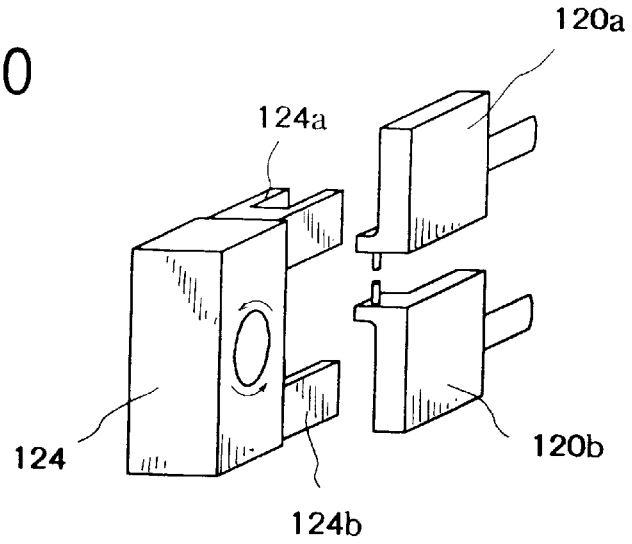
FIG. 20 is a perspective view of a chucking mechanism for chucking the welding rods.
Figure 21:
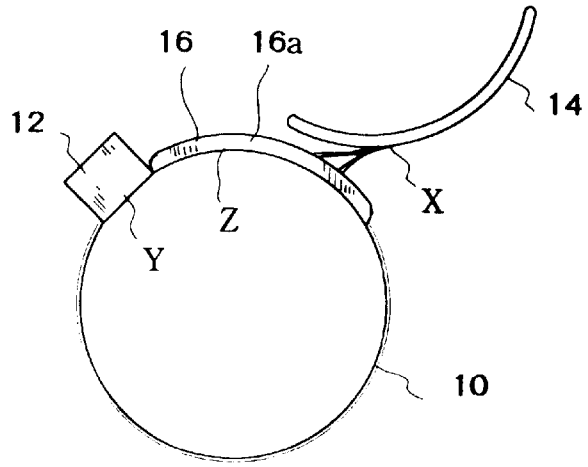
FIG. 21 is a front view of the clamping band.

An automatic welding rod exchanger, which is capable of exchanging the welding rods for welding the plate 16, is shown in FIGS. 19 and 20. In the automatic welding rod exchanger, a pair of welding rods 120*a* and 120*b* can be set to and pull out from a setting plate 122. A chucking mechanism 124 is capable of chucking a pair of the welding rods 120*a* and 120*b*. As shown in FIG. 20, the chucking mechanism 124 simultaneously chucks the upper welding rod 120*a* and the lower welding rod 120*b* and pulled out the welding rods 120*a* and 120*b* from the setting plate 122, then turned 180° so as to set to a welding position, at which the plate 16 is welded.

In the clamping band manufacturing machine of the present embodiment, the band-shaped material 20, the clasp material 30, the lever material 50 and the pate material 84 are fed to the main machine part 8, and the work piece is synchronously conveyed between the stages, so that the clamping band can be full-automatically manufactured. By full-automatically feeding, shaping and welding the parts, the manufacturing efficiency of the clamping bands can be highly improved. Further, the reliable clamping bands having even quality can be mass-produced by the alarm means, which detects abnormal machining conditions and generates the alert signals, the measuring means for measuring the length of the parts, the automatic welding rod exchanging means, etc.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A clamping band manufacturing machine, comprising:

a main machine part including:

a band shaping stage for forming a clasp material into a U-shape, welding the U-shaped clasp on a band section made by cutting a long band-shaped material with a prescribed length, bending a mid portion of the band section in an arc by a guide rod, overlapping both end portions;

a lever welding stage for welding a lever material and the overlapped portion of the band section and extending the lever material from the overlapped ends;

an examination stage for measuring a length of an overlapped portion of the band section and the lever material;

an arc shaping stage for bending the lever material in an arc by a fixed die and a shaping die;

a circular shaping stage for expanding the bent portion of the band section so as to form the band section into a circular loop; and a conveying mechanism synchronously conveying the work piece including the band section to each of said sages, which are serially arranged, with machining action of each of said stages; and feeding mechanisms for feeding the band-shaped material, the clasp material and the lever material to said main machine part.

2. The clamping band manufacturing machine according to claim 1, wherein said main machine part further includes a plate welding stage for making one end of a plate, which is bend in arc with curvature corresponding to that of the loop-shaped portion of the band section and which has reinforcing portions formed along both side edges, contact with an end of the clasp so as to position the plate on the loop-shaped portion of the band section and welding the plate thereon.

3. The clamping band manufacturing machine according to claim 1, wherein said circular shaping stage includes:

a bending section for bending the band section at a position near the overlapped portion of the band section and the lever so as to leave the band section away from a front end of the lever;

an expanding section for pressing an outer face of the band section, whose end portions have been overlapped, so as to expand the looped portion of the band section;

a circular shaping section for inserting a bunch of wires into the expanded looped portion of the band section and inserting a columnar shaft into the bunch of the wires so as to shape the looped portion into a circular loop shape; and a finishing section for inserting splitable dies into the circular looped portion of the band section and expanding the same by the splitable dies so as to form into a prescribed circle.

4. The clamping band manufacturing machine according to claim 1, wherein said arc shaping stage includes:

a fixed die;

a first shaping die for pressing the overlapped portion of the band section and the lever material with said fixed die so as to bend the overlapped portion in an arc; and a second shaping die for pressing the lever material with said fixed die so as to bend the lever material in an arc, said second die being provided near said first shaping die.

5. The clamping band manufacturing machine according to claim 1, wherein said band shaping stage and said lever welding stage respectively have sensors for detecting sparks, which generate while welding, and discharge the work piece, which is machined when the spark is detected, as a bad product.

6. The clamping band manufacturing machine according to claim 1, wherein each of said band shaping stage and said lever welding stage includes a pair of welding rods for pinching and holding welding portion and applying electric current for welding, and wherein said welding rods are automatically exchanged when they are used predetermined times.

7. The clamping band manufacturing machine according to claim 1, wherein said examination stage includes a CCD camera for measuring the length of the overlapped portion of the band section and discharge the work piece, whose length of the overlapped portion is out of an allowable range.

* * * * *